United States Patent [19]

Bartlett

[11] Patent Number: 4,977,847

[45] Date of Patent: Dec. 18, 1990

[54] LIFT AND RUDDER FIN ATTACHMENT

[76] Inventor: Dana W. Bartlett, 4477 S. W. Fenwick Lane, Palm City, Fla. 34990

[21] Appl. No.: 382,275

[22] Filed: Jul. 20, 1989

[51] Int. Cl.[5] ..... B63H 21/26

[52] U.S. Cl. ..... 114/274; 114/280; 440/900

[58] Field of Search ..... 114/274, 280, 281, 126; 440/66, 67, 71, 72, 900

[56] References Cited

U.S. PATENT DOCUMENTS

| | | | |
|---|---|---|---|
| 3,247,820 | 4/1966 | White | 114/280 |
| 3,433,195 | 3/1969 | Poole | 114/274 |
| 3,768,432 | 10/1973 | Spaulding | 440/66 |
| 4,205,618 | 6/1980 | Olsson | 114/281 |
| 4,445,452 | 5/1984 | Loch | 440/66 |
| 4,487,152 | 12/1984 | Larson | 114/274 |
| 4,597,742 | 7/1986 | Finkl | 440/71 X |
| 4,738,644 | 4/1988 | Happel | 440/900 |
| 4,744,779 | 5/1988 | Koehler | 440/900 |
| 4,756,265 | 7/1988 | Lane | 114/274 X |

*Primary Examiner*—Joseph F. Peters, Jr.
*Assistant Examiner*—Edwin L. Swinehart
*Attorney, Agent, or Firm*—L. S. Van Landingham, Jr.

[57] ABSTRACT

The Disclosure is concerned with lift and rudder fin attachments for outboard engines and inboard engines with outboard drives of the type used in the propulsion of boats. The attachments may be adjusted to vary the amount of lift that is produced under a given set of operating conditions, and they also have the added advantage of greatly enhancing steering control at slow speeds and during slow speed operations such as trolling and docking.

20 Claims, 4 Drawing Sheets

FIG. 5
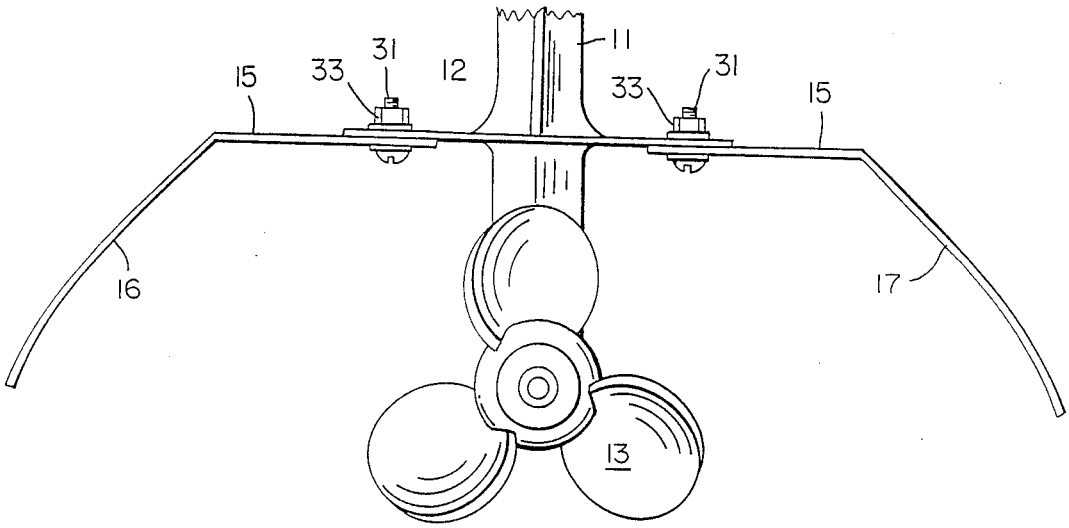
FIG. 6
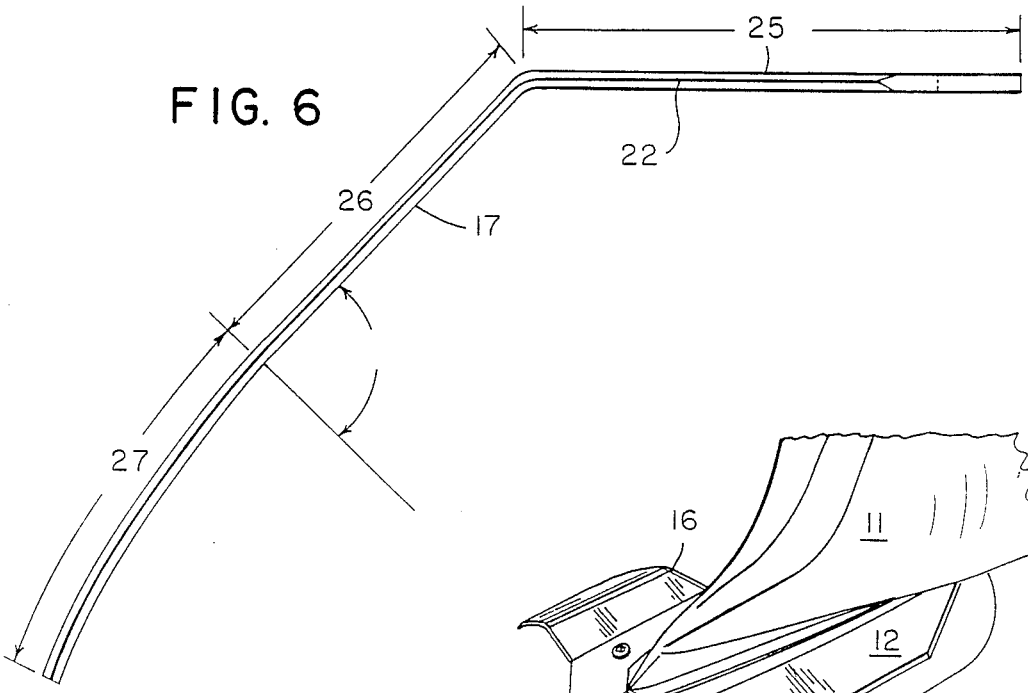
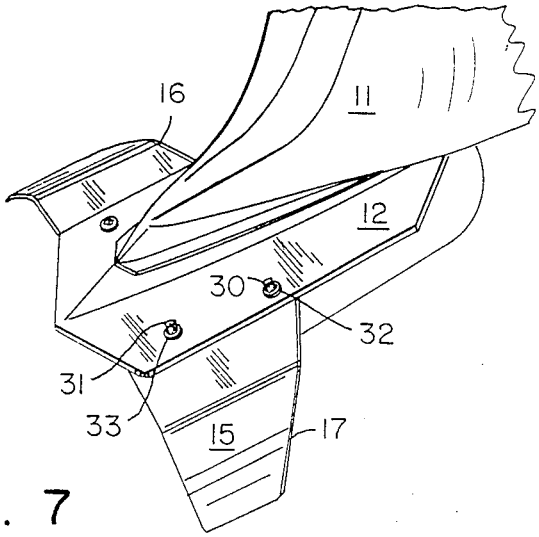
FIG. 7

LIFT AND RUDDER FIN ATTACHMENT

THE BACKGROUND OF THE INVENTION

1. The Field Of The Invention

This invention broadly relates to lift and rudder fin attachments for outboard engines and inboard engines with outboard drives of the type used in the propulsion of boats. In some of its more specific aspects, the invention is concerned with an improved lift and rudder fin attachment that is adjustable whereby the amount of lift produced thereby may be varied as desired. In one of its further aspects, the invention is concerned with lift and rudder fin attachments which give greatly enhanced steering control at slow speeds and during slow speed operations such as trollinq and docking.

2. The Description Of The Prior Art

Various devices have been proposed heretofore for use with outboard and inboard boat engines for the purpose of trimming and stabilizing boats at elevated speeds and/or under adverse operating conditions. Examples of prior art devices of this type are disclosed U.S. Pat. Nos. 3,247,820, 3,433,195, 4,205,618, 4,487,152, 4,738,644, 4,744,779 and 4,756,265.

The above-described prior art devices have a number of limitations and disadvantages which are inherent in their design, construction and method of use. For example, the prior art devices are not efficient or are not capable of being attached to the boat engine at the most effective location, or are complicated, expensive or difficult to build and use, or must be custom designed for use with each type or model of boat engine, or are not capable of enhancing steering control at slow speeds, and/or are not capable of being adjusted to provide the amount of lift that is desired for a given set of operating conditions.

The aforementioned and other deficiencies and disadvantages of the prior art devices have long been recognized by those skilled in this art. However, an entirely satisfactory alternative thereto was not available prior to the present invention.

THE SUMMARY OF THE INVENTION

The present invention overcomes the disadvantages and deficiencies of the prior art devices discussed above. This is accomplished by providing a lift and rudder fin attachment for outboard engines and inboard engines with outboard drives of the novel and improved design and construction described and claimed hereinafter.

It is an object of the present invention to provide an improved lift and rudder fin attachment for outboard engines and inboard engines with outboard drives that is adjustable around the generally upright or vertical axis to thereby vary the amount of lift that is produced under a given set of operating conditions.

It is a further object of the present invention to provide an improved lift and rudder fin attachment for outboard engines and inboard engines with outboard drives that is adjustable around the generally transverse or horizontal axis to vary the amount of lift that is produced thereby under a given set of operating conditions.

It is a further object of the present invention to provide an improved lift and rudder fin attachment for outboard engines and inboard engines with outboard drives wherein at least the outboard portion thereof has a configuration whereby it is substantially concentric to the propeller arc and efficiency is greatly increased.

Still other objects and advantages of the present invention will be apparent from the following detailed description and the accompanying drawings.

THE BRIEF DESCRIPTION OF THE ACCOMPANYING DRAWINGS

The invention will be described hereinafter in greater particularity with reference to the presently preferred embodiments thereof illustrated in the accompanying drawings, wherein FIG. 1 is a side view of a typical prior art boat propelled by an outboard engine, which further illustrates in phantom line the tendency of the bow to rise under certain operating conditions;

FIG. 2 of the drawings is a top or plan view of the left fin of the attachment of the invention;

FIG. 5 is an enlarged fragmentary view in elevation of the attachment of the invention installed on the cavitation plate of a prior art outboard engine;

FIG. 6 is a view in elevation of the leading edge or end of the right fin of FIG. 3 which further illustrates the configuration thereof;

FIG. 7 is a fragmentary perspective view further illustrating the attachment of the invention installed on the cavitation plate of an outboard engine;

THE DETAILED DESCRIPTION OF THE INVENTION

Figure 1:
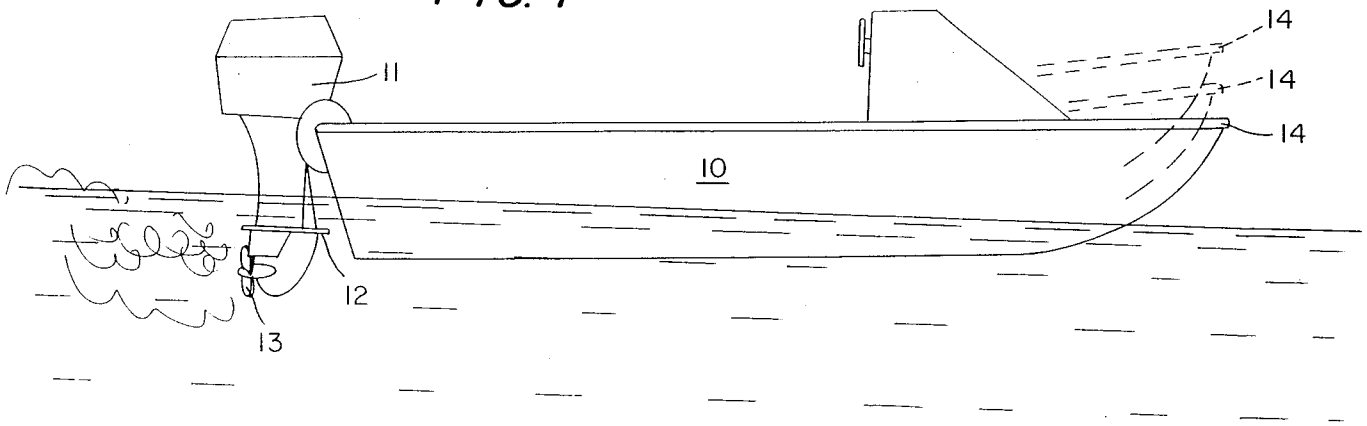

Referring now to the drawings FIG. 1 illustrates a prior art boat 10 propelled by a prior art outboard engine 11 having a generally horizontal and longitudinally extending cavitation plate 12 which is mounted above the driven propeller 13. As is illustrated in phantom line, the bow 14 tends to rise above the optimum water level, which is illustrated in solid line, under certain operating conditions such as increased or high speed, unbalanced or heavy loads, rough water, and the like. The prior art cited hereinbefore may be referred to for a more detailed discussion of such operating Conditions and their effect on the operation of boat 10. The adjustable lift and rudder fin attachment 15 of the invention may be attached to cavitation plate 12 of engine 11 and, when the bow 14 is raised to a position shown in phantom line, the attachment 15 may be adjusted to the proper setting to bring bow 14 back down to the optimum level shown in solid line.

Figure 3:
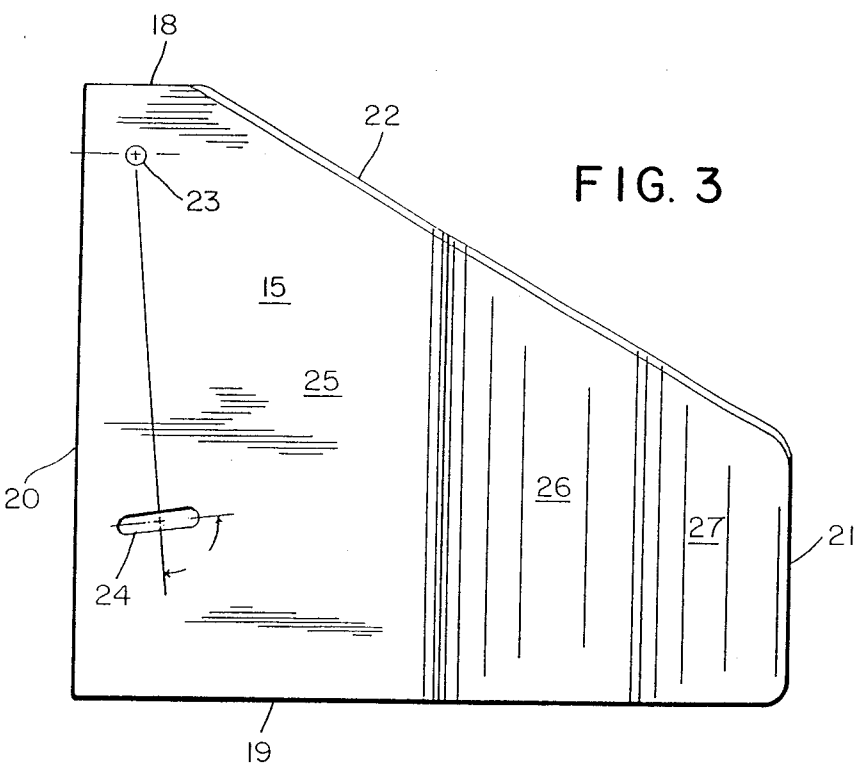
FIG. 3 is a top or plan view of the right fin of the attachment of the invention.
Figure 2:
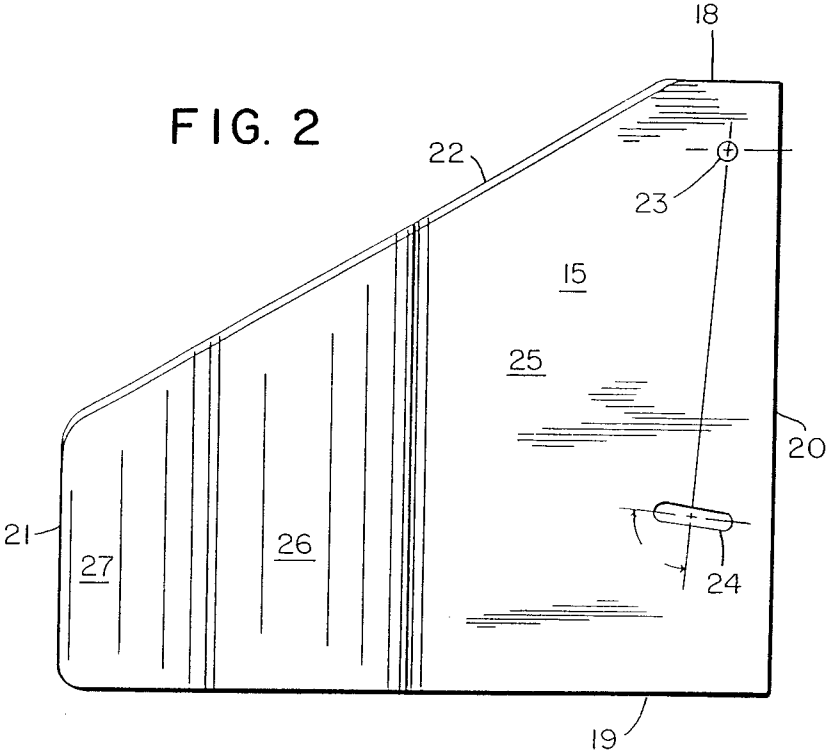

The attachment 15 has a left fin 16 and a right fin 17 which are mirror images of each other. Each of the fins 16 and 17 have leading ends or edges 18 and trailing edges 19, and inboard sides 20 and outboard sides 21. The major portion of the leading edges 18 are sloped rearward at an angle such as is shown in FIGS. 2 and 3, and the sloped edges 18 are sharpened to provide sharpened edges 22 for the purpose of reducing drag when the boat 10 is moving through the water. Each of the fins 16 and 17 is provided with an annular opening 23 adjacent the leading ends 18, and a generally transversely extending slot 24 adjacent the trailing edges 19. Each of the fins 16 and 17 is also shaped by bending or the like to thereby form three distinct portions which extend longitudinally thereof, including relatively flat mounting portions 25, portions 26 which form a distinct angle with portions 25, such as approximately 135 degrees, and outboard portions 27 which are bent so as to form a radius whereby portions 27 are concentric to the arc of propeller 13. Thus, the pair of fins 16 and 17 extend outboard from their points of attachment to the cavitation plate 12 and generally downward and toward the propeller 13 whereby the fins 16 and 17 encompass at least the upper portion of the propeller 13 in spaced relationship.

As is best seen in FIGS. 5, 7, 8 and 9, the cavitation plate 12 is provided with openings 28 and 29 on either side which cooperate with openings 23 and slots 24 to receive bolts 30 and 31, respectively.

Figure 8:
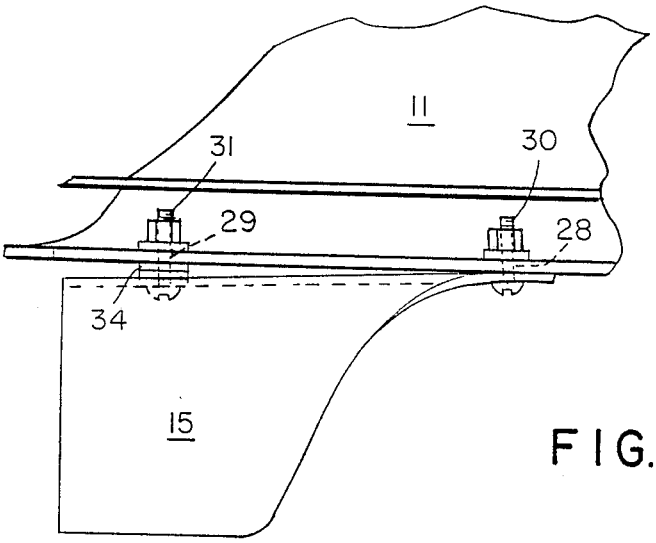
FIG. 8 is a fragmentary side view in elevation illustrating the adjustment of the attachment of the invention around the horizontal axis.
Figure 9:
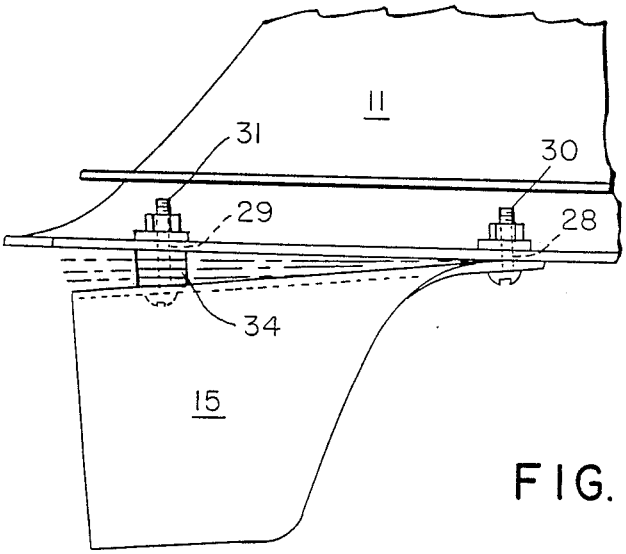
FIG. 9 is a view similar to FIG. 8 which further illustrates the variable adjustment of the attachment of the invention around the horizontal axis.

As is best seen in FIGS. 5, 8 and 9, the fins 16 and 17 are positioned underneath the cavitation plate 12 and the bolts 30 and 31 are passed upward through the openings 23 and slots 24 and the openings 28 and 29, and nuts 32 and 33 ar tightened thereon to thereby hold the fins 16 and 17 tightly in place.

Figure 4:
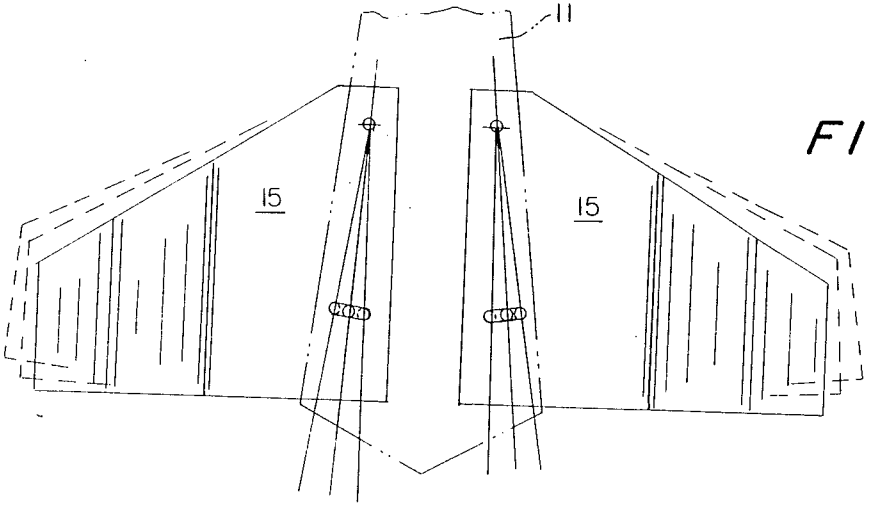
FIG. 4 is a top or plan view of the attachment of the invention which diagrammatically illustrates in phantom line the adjustment thereof around the upright or vertical axis.

FIG. 4 illustrates the adjustment of the fins 16 and 17 around the vertical axis. This is accomplished by loosening the nuts 32 and 33 and moving the trailing ends 19 inboard or outboard as shown in phantom line in FIG. 4. Moving the trailing ends 19 inboard increases the amount of lift, and moving the trailing ends 19 outboard decreases the amount of lift. When the proper adjustments are made to provide the desired amount of lift for a given set of operating conditions, then the nuts 32 and 33 are tightened t thereby retain the adjusted fins 16 and 17 in place.

FIGS. 8 and 9 of the drawings illustrate the adjustment of the fins 16 and 17 around the horizontal axis. This is accomplished by loosening the nuts 32 and removing the nuts 33, and placing washers or other suitable spacing means on the bolts 31 between the upper surface of fins 16 and 17 and the undersurface of cavitation plate 12. When the desired number of washers 34 are in place, then the nuts 33 are replaced on bolts 31, and nuts 32 and 33 are retightened t thereby hold the fins 16 and 17 tightly in the adjusted position. Adding additional washers 34 increases the angle of incidence and also increases the amount of lift. Thus, by adjusting the number of washers 34, it is possible to adjust the angle of incidence and in turn the amount of lift for a given set of operating conditions.

The fins 16 and 17, the bolts 30 and 31, the nuts 32 and 33 and the washers 34 are preferably constructed of stainless steel or other non-corrosive metals in most instances. However, it is possible to use metals other than stainless steel such as aluminum, and plastics, nylon, and the like. It is understood that any suitable metal, plastic or other material of construction may be used.

From the foregoing discussion, it may be seen that the fins 16 and 17 may be adjusted around both their vertical and horizontal axis to vary the amount of lift that is produced under a given set of operating conditions. Also, having the radius of portions 27 concentric to the arc of the propeller 13 greatly increases efficiency. The configuration of the attachment 15 is such that there is improved steering control and especially at slow speed and in operations conducted at slow speeds such as trolling or docking. This is especially helpful in single engine installations.

In one presently preferred specific embodiment of the attachment 15, the portions 25 are approximately $3\frac{1}{2}$ inches in length, the portions 26 are approximately $2\frac{5}{8}$ inches in length, and the portions 27 are approximately $2\frac{5}{8}$ inches in length. The angle formed at the junction between portions 25 and 26 is preferably about 135 degrees The radius of portion 27 is preferably such that portion 27 is concentric with the arc of the propeller 13. It is understood that the invention is not limited to these specific figures.

While certain preferred embodiments of the invention have been specifically illustrated and described herein, it is understood that modifications may be made therein that are within the scope of the invention. The foregoing detailed description and the accompanying drawings are therefore for purposes of illustration only, and are not intended as being limited to the spirit or scope of the appended claims

I claim:

1. A lift and rudder fin attachment for outboard engines and inboard engines with outboard drive, the said engines being for use in the propulsion of boats and of the class including a generally horizontal and longitudinally extending cavitation plate which is mounted above a propeller driven thereby, the said attachment including a pair of cooperating left and right adjustable fins having leading and trailing ends and inboard and outboard sides, first means for attaching said fins to said cavitation plate at points adjacent said leading ends and said inboard sides thereof, second means for attaching said fins to said cavitation plate at points adjacent said trailing ends and said inboard sides thereof, the said pair of fins extending outboard from their points of attachment to the cavitation plate and generally downward whereby the said pair of fins encompass at least the upper portion of the propeller in spaced relationship, the configuration of the said fins being such that the amount of lift provided thereby may be varied by generally horizontal adjustment thereof around the said first attaching means, and the said first and second attaching means including means for allowing the said fins to be adjusted by generally horizontal movement thereof around the said first attaching means to thereby vary the amount of lift provided thereby.

2. The lift and rudder fin attachment of claim 1 wherein said attachment is attached in place on the cavitation plate of a said engine by said first and second attaching means.

3. The lift and rudder fin attachment of claim 1 wherein said first attaching means comprises removable and replaceable threaded bolts and nuts and cooperating openings therefor in said left and right fins.

4. The lift and rudder fin attachment of claim 1 wherein said second attaching means comprises removable and replaceable threaded bolts and nuts and cooperating generally transversely extending slots in said lift and right fins.

5. The lift and rudder fin attachment of claim 2 wherein the said first attaching means comprises removable and replaceable threaded bolts and nuts which pass through cooperating openings therefor in said left and right fins and in said cavitation plate.

6. The lift and rudder fin attachment of claim 2 wherein said first attaching means comprises removable and replaceable threaded bolts and nuts and cooperating openings therefor in said left and right fins and cooperating openings in said cavitation plate, and the said second attaching means comprises removable and replaceable threaded nuts and bolts and cooperating generally transversely extending slots in said left and right fins and cooperating openings in said cavitation plate.

7. The lift and rudder fin attachment of claim 6 wherein the said pair of fins extend outboard and downward initially at an angle of about 135 degrees with respect to said inboard sides and terminates in outboard end portions, and the said outboard end portions thereof are substantially concentric with the propeller arc.

8. A lift and rudder fin attachment for outboard engines and inboard engines with outboard drive, the said engines being for use in the propulsion of boats and of the class including a generally horizontal and longitudinally extending cavitation plate which is mounted above a propeller driven thereby, the said attachment including a pair of cooperating left and right adjustable fins having leading and trailing ends and inboard and outboard sides, first means for attaching said fins to said cavitation plate at points adjacent said leading ends and said inboard sides thereof, second means for attaching said fins to said cavitation plate at points adjacent said trailing ends and said inboard sides thereof, the said pair of fins extending outboard from their points of attachment to the cavitation plate and generally downward whereby the said pair of fins encompass at least the upper portion of the propeller in spaced relationship, the configuration of the said fins being such that the amount of lift provided thereby may be varied by adjustment of the trailing ends thereof in a generally upright plane to change the angle of incidence, and the said first and second attaching means including means for allowing the said trailing ends of the fins to be adjusted in a generally upright plane to thereby change the angle of incidence and vary the amount of lift provided thereby.

9. The lift and rudder fin attachment of claim 8 wherein said attachment is attached in place on the cavitation plate of a said engine by said first and second attaching means.

10. The lift and rudder fin attachment of claim 8 wherein said first attaching means comprises removable and replaceable threaded bolts and nuts and cooperating openings therefor in said left and right fins.

11. The lift and rudder fin attachment of claim 9 wherein the said adjusting means for the trailing ends of the fins comprises spacing means positioned between the fins and the cavitation plate.

12. The lift and rudder fin attachment of claim 11 wherein said first attaching means comprises removable and replaceable threaded bolts and nuts which pass through cooperating openings therefor in said left and right fins and cooperating openings in said cavitation plate, the said second attaching means comprises removable and replaceable threaded nuts and bolts and cooperating generally transversely extending slots in said left and right fins and cooperating openings in said cavitation plate, and the said spacing means comprises at least one washer on each of said bolts of the said second attaching means.

13. The lift and rudder fin attachment of claim 12 wherein the said pair of fins extend outboard and downward initially at an angle of about 135 degrees with respect to said inboard sides and terminate in outboard end portions, and the said outboard end portions thereof are substantially concentric with the propeller arc.

14. The lift and rudder fin attachment of claim 8 wherein said second attaching means comprises removable and replaceable threaded bolts and nuts and cooperating generally transversely extending slots in said left and right fins.

15. A lift and rudder fin attachment for outboard engines and inboard engines with outboard drive, the said engines being for use in the propulsion of boats and of the class including a generally horizontal and longitudinally extending cavitation plate which is mounted above a propeller driven thereby, the said attachment including a pair of cooperating left and right adjustable fins having leading and trailing ends and inboard and outboard sides, first means for attaching said fins to said cavitation plate at points adjacent said leading ends and said inboard sides thereof, second means for attaching said fins to said cavitation plate at points adjacent said trailing ends and said inboard sides thereof, the said pair of fins extending outboard from their points of attachment to the cavitation plate and generally downward whereby the said pair of fins encompass at least the upper portion of the propeller in spaced relationship, the configuration of the said fins being such that at least the outboard end portions thereof are curved downward whereby they are substantially concentric with the propeller arc, and spacing means for positioning between the said left and right fins and the said cavitation plate for adjusting the angle of incidence of said left and right fins and varying the amount of lift provided thereby.

16. The lift and rudder fin attachment of claim 15 wherein said attachment is attached in place on the cavitation plate of a said engine by means comprising said first and second attaching means.

17. The lift and rudder fin attachment of claim 15 wherein the said pair of fins extend outboard and downward initially at an angle of about 135 degrees with respect to said inboard sides and terminate in outboard end portions, and the said outboard end portions thereof are substantially concentric with the propeller arc.

18. The lift and rudder fin attachment of claim 15 wherein said first attaching means comprises removable and replaceable threaded bolts and nuts and cooperating openings therefore in said left and right fins.

19. The lift and rudder fin attachment of claim 16 wherein the said spacing means being positioned between the upper surfaces of the fins and the lower surface of the cavitation plate.

20. The lift and rudder fin attachment of claim 19 wherein said first attaching means comprises removable and replaceable threaded bolts and nuts and cooperating openings therefor in said left and right fins and cooperating openings in said cavitation plate, the said second attaching means comprises removable and replaceable threaded nuts and bolts and cooperating generally transversely extending slots in said left and right fins and cooperating openings in said cavitation plate, and the said spacing means comprises at least one washer on each of said bolts of the said second attaching means. appended claims.

* * * * *